US008166858B2

(12) United States Patent
Luquette

(10) Patent No.: US 8,166,858 B2
(45) Date of Patent: May 1, 2012

(54) TRIM EJECTOR FOR EJECTING THE TRIM PRODUCED BY A RULE OF A ROTARY STEEL RULE DIE APPARATUS OR THE LIKE

(75) Inventor: Daniel Luquette, Kirkland (CA)

(73) Assignee: Proden Inc., Québec (CA)

( * ) Notice: Subject to any disclaimer, the term of this patent is extended or adjusted under 35 U.S.C. 154(b) by 394 days.

(21) Appl. No.: 12/440,002

(22) PCT Filed: Oct. 4, 2007

(86) PCT No.: PCT/CA2007/001769

§ 371 (c)(1),
(2), (4) Date: Mar. 4, 2009

(87) PCT Pub. No.: WO2008/043171

PCT Pub. Date: Apr. 17, 2008

(65) Prior Publication Data

US 2010/0037741 A1 Feb. 18, 2010

Related U.S. Application Data

(60) Provisional application No. 60/829,039, filed on Oct. 11, 2006.

(51) Int. Cl.
*B26D 7/06* (2006.01)

(52) U.S. Cl. ..... 83/115; 83/117; 83/119; 83/128

(58) Field of Classification Search ..... 83/115, 83/119, 125, 128, 117, 123, 124, 127, 118, 83/653, 373, 472; 493/342, 373, 472
See application file for complete search history.

(56) References Cited

U.S. PATENT DOCUMENTS

| | | | | |
|---|---|---|---|---|
| 2,679,291 | A * | 5/1954 | Collinson | 83/284 |
| 3,186,274 | A * | 6/1965 | Winkler et al. | 83/103 |
| 3,231,261 | A | 1/1966 | Huffman | |
| 3,499,370 | A * | 3/1970 | Gugolz et al. | 493/342 |
| 3,807,262 | A * | 4/1974 | Vits | 83/117 |

(Continued)

OTHER PUBLICATIONS

Container Graphics Corporation, "Rotary Diecutters Everywhere Are Flipping Their Trim," http://www.containergraphics.com/cgi-bin/cgcweb/index.pl?disppage-/products/flipper, Dec. 1, 2009.

(Continued)

*Primary Examiner* — Boyer D Ashley
*Assistant Examiner* — Omar Flores Sanchez
(74) *Attorney, Agent, or Firm* — Venable LLP; Robert Kinberg

(57) ABSTRACT

A trim ejector for ejecting the trim produced by a steel rule of a rotary steel rule die apparatus includes a die cylinder having a die board provided with the rule and an anvil roll positioned parallel to the die cylinder to define a sheet receiving gap therebetween. The trim ejector has a flexible body defining a trim-ejecting surface extending between an ejecting edge and a stem portion, an anchor portion connected to the stem portion of the flexible body for securing the flexible body to the die board to position the ejecting edge of the flexible body adjacent and parallel to the rule, and a compressible biasing member secured to the flexible body on a side opposite the trim-ejecting surface. The compressible biasing member forces the flexible body to a neutral position, corresponding to no tension being applied to the stem portion, when the flexible body is moved away from the neutral position under passage of a sheet in a sheet receiving gap.

13 Claims, 8 Drawing Sheets

U.S. PATENT DOCUMENTS

| | | | | | |
|---|---|---|---|---|---|
| 3,827,322 | A | | 8/1974 | Saunders et al. | |
| 3,946,627 | A | * | 3/1976 | Hofmann | 83/117 |
| 4,009,626 | A | | 3/1977 | Gressman | |
| 4,224,851 | A | * | 9/1980 | Imai | 83/117 |
| 4,349,140 | A | * | 9/1982 | Passafiume | 225/97 |
| 4,463,640 | A | | 8/1984 | Cogswell et al. | |
| 4,499,802 | A | | 2/1985 | Simpson | |
| 5,111,725 | A | | 5/1992 | Simpson et al. | |
| 5,161,442 | A | * | 11/1992 | Rilitz et al. | 83/117 |
| 5,179,882 | A | * | 1/1993 | Takeuchi et al. | 83/125 |
| 5,363,728 | A | * | 11/1994 | Elsner et al. | 83/23 |
| 5,881,620 | A | | 3/1999 | Smithwick, Jr. et al. | |
| 6,071,225 | A | * | 6/2000 | Kucharski | 493/471 |
| 6,408,729 | B1 | | 6/2002 | Johnson | |
| 6,644,153 | B1 | | 11/2003 | Gordon | |
| 6,925,918 | B1 | | 8/2005 | Bunge | |
| 7,044,040 | B1 | | 5/2006 | Smith | |
| 7,111,734 | B2 | | 9/2006 | Robinson, Jr. | |

OTHER PUBLICATIONS

International Search Report and Written Opinion, mailed Jan. 28, 2008, Issued in PCT/CA2007/001769.

Supplementary European Search Report of EP 07 81 5948 Dated Feb. 29, 2012.

* cited by examiner

TRIM EJECTOR FOR EJECTING THE TRIM PRODUCED BY A RULE OF A ROTARY STEEL RULE DIE APPARATUS OR THE LIKE

FIELD

The present invention relates to paperboard die-cutting. More specifically, the present invention relates to a trim ejector for ejecting the trim produced by a rule of a rotary steel rule die apparatus or the like.

BACKGROUND

The use of a rotary steel rule die apparatus for paperboard die-cutting is well-known. Such apparatus comprises a die cylinder, having a die board, and an anvil roll positioned parallel to the die cylinder so as to define a sheet receiving gap therebetween. The die board is provided with steel rules so mounted to the board in a press-fitted way as to yield a predetermined shape to the sheet to cut, which can be a corrugated board or other sheet materials. The assembly of rules which yields the predetermined shape cut in the sheet will be referred to herein as the die cutting pattern or matrix.

It is a common practice in the field of steel rule die cutting to provide a width of about ½" (1.27 cm) of extra sheet beyond the rules on all sides except on the front side where an extra width of about ¼" (0.63 cm) is provided. This extra width is provided to prevent centering problem of the sheet, and to help ejecting the trim.

Currently in the paperboard die-cutting industry, a major part of the waste in the die-cutting operation of corrugated carton relates to the trim around the carton's pattern.

A rotary steel rule die apparatus which would allow minimizing the trim around the carton's pattern is thus desirable.

DETAILED DESCRIPTION

Figure 1:
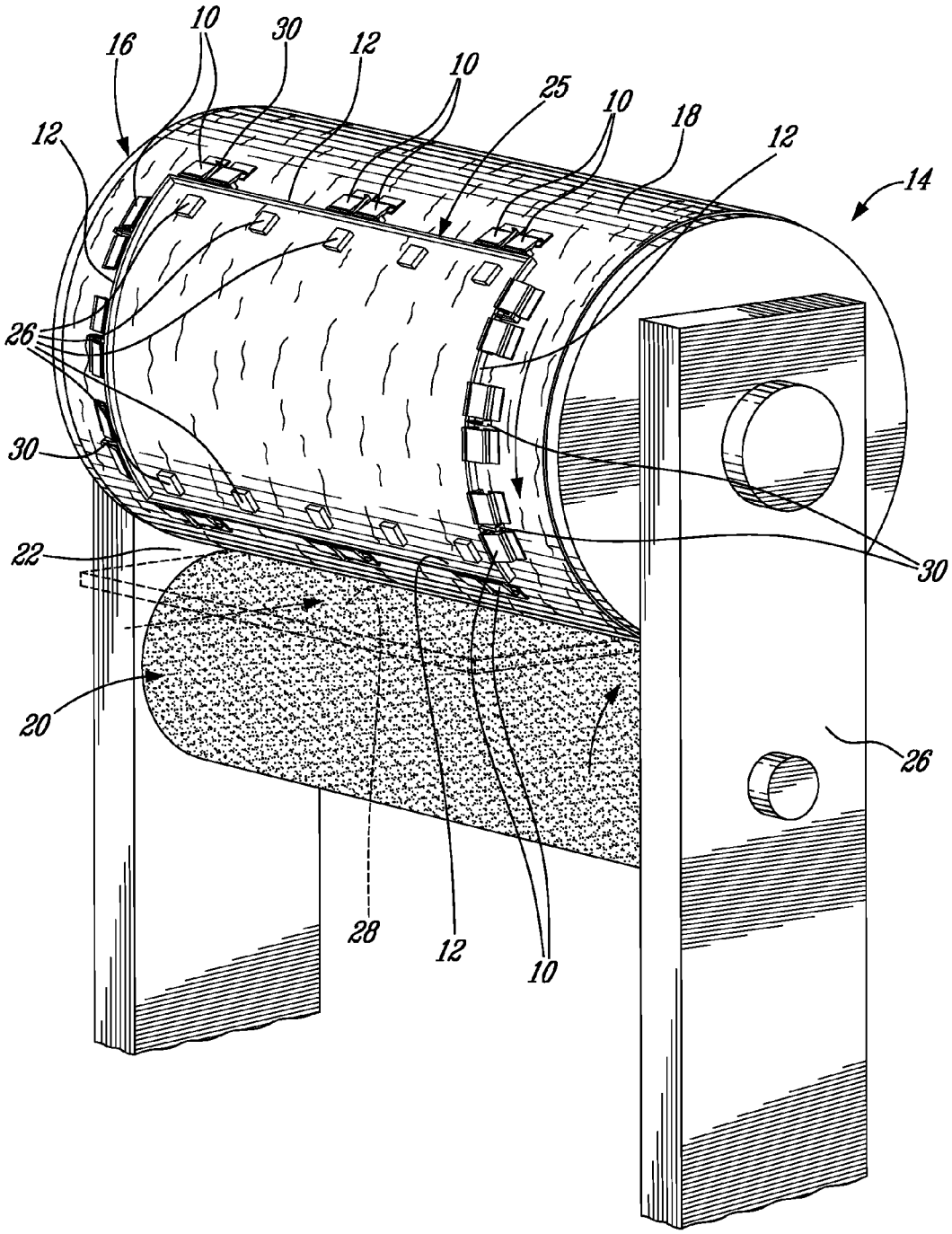
FIG. 1 is a perspective partially schematic view of a rotary steel rule die apparatus provided with trim ejectors according to a first illustrative embodiment of the present invention.

In accordance with a first aspect of the present invention, there is provided a trim ejector for ejecting the trim produced by a rule of a rotary steel rule die apparatus, the rotary steel rule die apparatus further comprising a die cylinder including a die board provided with the rule and an anvil roll positioned parallel to the die cylinder so as to define a sheet receiving gap therebetween, the trim ejector comprising:

a leaf-like body defining a trim-ejecting surface extending between an ejecting edge and a stem portion;

an anchor portion connected to the stem portion of the leaf-like body for securing the leaf-like body to the die board so that the ejecting edge of the leaf-like body is positioned adjacent the rule parallel therefrom; and a compressible biasing member secured to the leaf-like body on a side thereof opposite the trim-ejecting surface; the compressible biasing member being for forcing the leaf-like body to a neutral position, corresponding to no tension being applied to the stem portion, when the leaf-like member is moved away from the neutral position by a sheet in the sheet receiving gap;

whereby, in operation, when the sheet in the sheet receiving gap causes the rule to cut a trim from the sheet, the sheet exerts the tension on the stem portion and the biasing member is compressed; when the sheet exits the sheet receiving gap, the tension on the stem portion is released and the compressible biasing member forces the leaf-like body to its neutral position which then pushes onto the trim and causes an ejection of the trim.

According to a second aspect of the present invention, there is provided a rotary steel rule die apparatus comprising:

a die cylinder rotatably mounted to a frame including a die board provided with a plurality of steel rules mounted to the die board so as to define a die cutting tool;

an anvil roll mounted to the frame so as to be positioned parallel to the die cylinder and so as to define a sheet receiving gap therebetween; each of the plurality of steel rules producing a respective trim following a passage of a sheet in the sheet receiving gap;

the improvement wherein the apparatus further comprising:

at least one trim ejector mounted to the die board adjacent one of the plurality of steel rules for ejecting the respective trim produced by the one of the plurality of steel rules, the trim ejector comprising:

a leaf-like body defining a trim-ejecting surface extending between an ejecting edge and a stem portion;

an anchor portion connected to the stem portion of the leaf-like body secured the leaf-like body to the die board so that the ejecting edge of the leaf-like body is positioned adjacent the one of the plurality of steel rules generally parallel therefrom; and a compressible biasing member secured to the leaf-like body on a side thereof opposite the trim-ejecting surface; the compressible biasing member being for forcing the leaf-like body to a neutral position corresponding to no tension being applied to the stem portion, when the leaf-like member is moved away from the neutral position by a sheet in the sheet receiving gap;

whereby, in operation, when the sheet in the sheet receiving gap causes the rule to cut a trim from the sheet, the sheet exerts the tension on the stem portion and the biasing member is compressed; when the sheet exits the sheet receiving gap, the tension on the stem portion is released and the compressible biasing member forces the leaf-like body to its neutral position which then pushes onto the trim and causes an ejection of the trim.

It has been found that the use of a trim ejector according to the present invention allows yielding an extra width of only about ⅛" (3.2 mm) on the sheet beyond the rules for example. This results in important carton savings.

The trim ejector according to the present invention provides a relatively powerful and fast ejection of the trim around the pattern defined by the rules, which minimizes the bringing of trim and carton's waste in the subsequent cuttings.

According to a third aspect of the present invention, there is provided an ejector for ejecting a sheet in a rotary steel rule die apparatus, the rotary steel rule die apparatus further comprising a die cylinder including a die board provided with a matrix of steel rules and an anvil roll positioned parallel to the die cylinder so as to define a sheet receiving gap therebetween, the ejector comprising:

a leaf-like body defining a sheet-ejecting surface extending between an ejecting edge and a stem portion;

an anchor portion connected to the stem portion of the leaf-like body for securing the leaf-like body to the die board so that the ejecting edge of the leaf-like body is positioned adjacent the rule generally parallel therefrom; and a compressible biasing member secured to the leaf-like body on a side thereof opposite the sheet-ejecting surface; the compressible biasing member being for forcing the leaf-like body to a neutral position corresponding to no tension being applied to the stem portion, when the leaf-like member is moved away from the neutral position by a sheet in the sheet receiving gap;

whereby, in operation, when the sheet is in the sheet receiving gap, the sheet exerts the tension on the stem portion and the biasing member is compressed; when the sheet exits the sheet receiving gap, the tension on the stem portion is released and the compressible biasing member forces the leaf-like body to its neutral position which then pushes onto the sheet and causes an ejection of the sheet.

Other objects, advantages and features of the present invention will become more apparent upon reading the following non restrictive description of illustrated embodiments thereof, given by way of example only with reference to the accompanying drawings.

Figure 2:
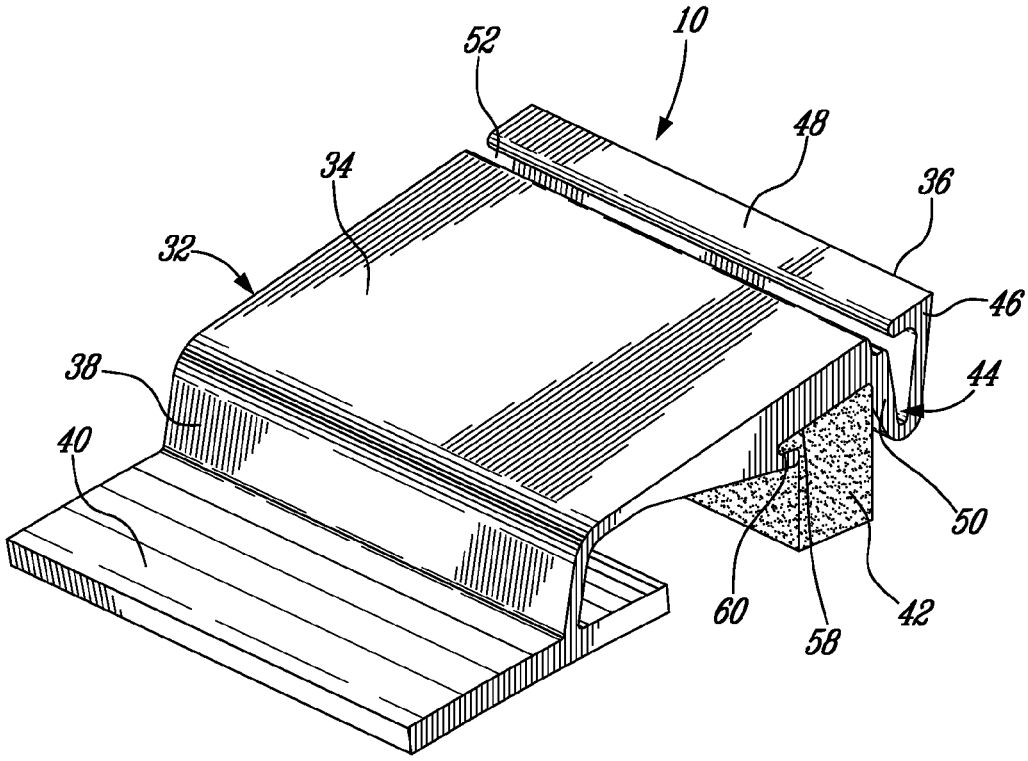
FIG. 2 is a perspective view of one of the trim ejectors from FIG. 1.
Figure 3:
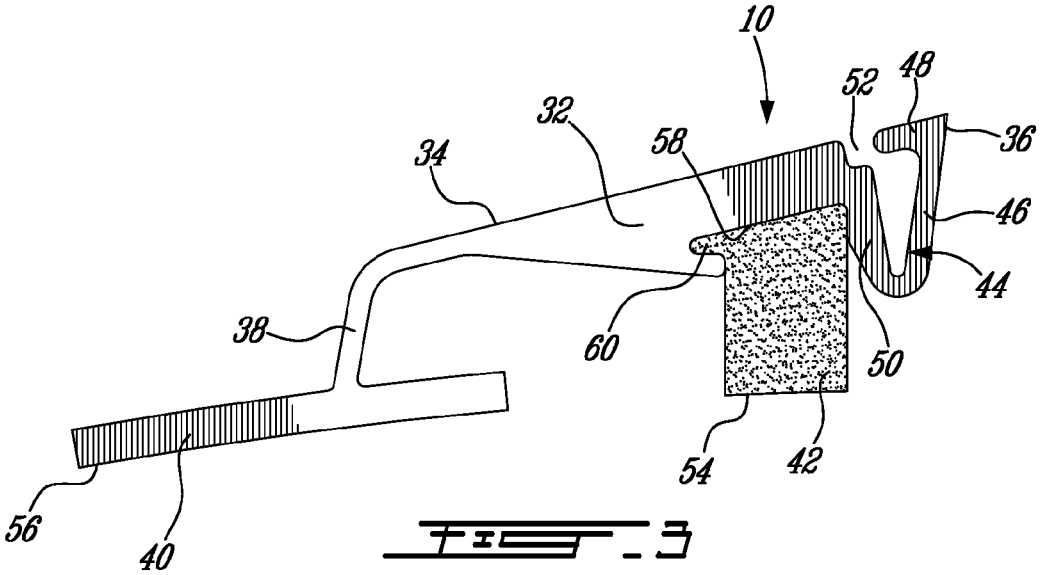
FIG. 3 is a side elevation of the trim ejector from FIG. 2.

Turning now to FIGS. 1 to 3, a trim ejector 10 for ejecting the trim 11 produced by a rule 12 of a rotary steel rule die apparatus 14 according to a first illustrative embodiment of the present invention will now be described.

As it is well-known, the rotary steel rule die apparatus 14 comprises a die cylinder 16 including a die board 18 and an anvil roll 20 positioned parallel to the die cylinder 16 so as to define a sheet-receiving gap 22 therebetween.

Figure 4:
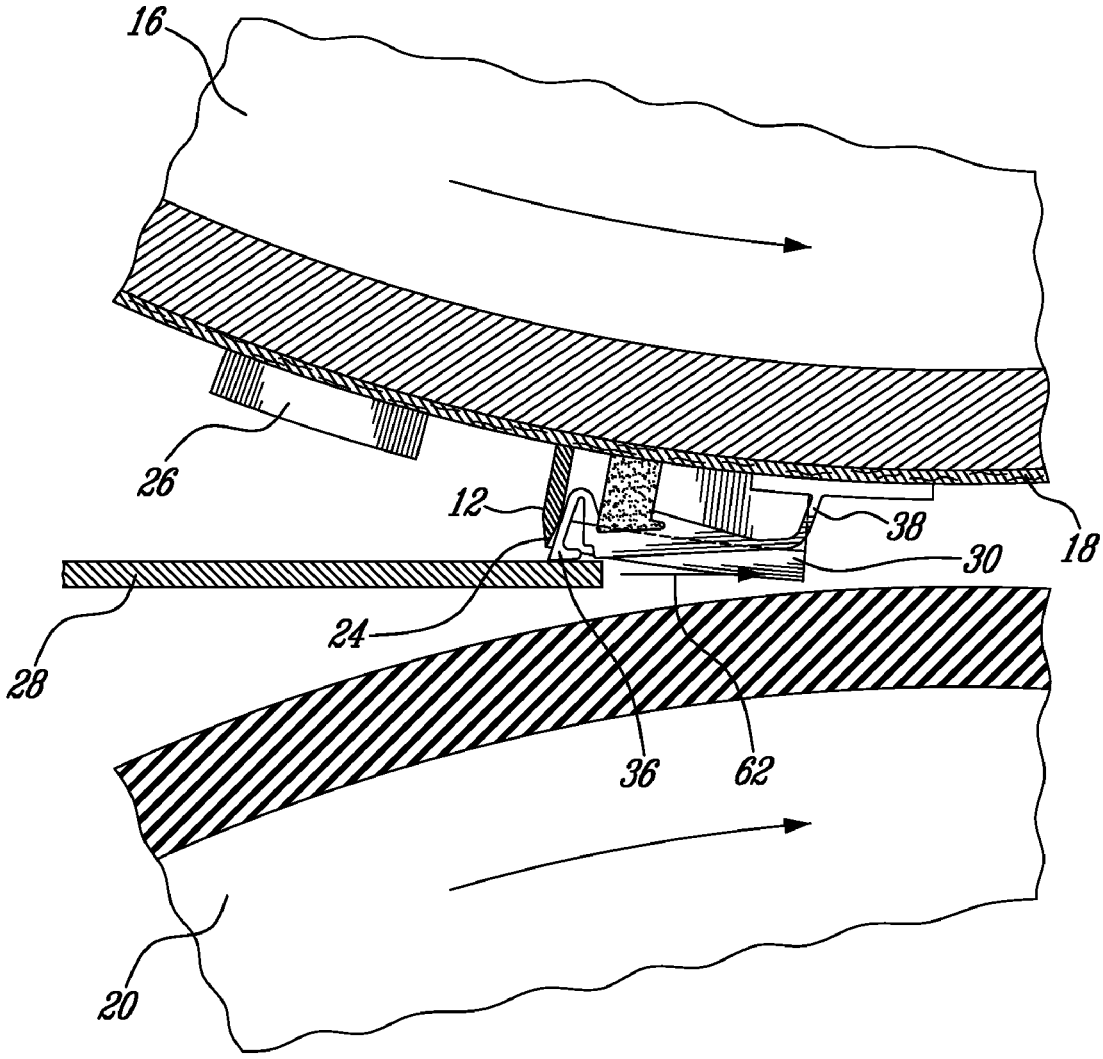
FIGS. 4 to 7 are side elevational close up views of the rotary steel rule die apparatus from FIG. 1, illustrating the operation of one of the trim ejectors before, during and after cutting.

As it is conventionally known, the rules 12 (four (4) illustrated) are press-fitted to the die board 18. As illustrated in FIG. 4, for example, each rule 12 has center bevel tip 24. According to the illustrated example of FIG. 1, the four rules 12 are so mounted to the die board 18 as to define a rectangle pattern 25.

As will become more apparent upon reading the following description, trim ejectors 10 according to the present invention can be used to eject the trims resulting from a different number of rules positioned according to other patterns (not illustrated).

The die cylinder 16 is conventionally hollow and made of steel or of another heavy duty material. The anvil roll 20 is also a hollow cylinder conventionally provided with a polyurethane coating. Both rolls are rotatably mounted to a frame 26. The rotation of the die cylinder 16 is actuated by a drive assembly (not shown).

The die board 18 is mounted to the die cylinder via fasteners (not shown). The board is made for example of arcuate shaped plywood. It can also be made of other material, such as paper based board and polymeric material for example.

The rotary steel rule die apparatus 14 further includes a plurality of rubber blocks 26. The rubber blocks 26 are provided to suspend and eject the blank resulting from the cut of the sheet 28 within the rectangle pattern 25 and therefore ease its removal by gravity. The rubber blocks 26 are of course not limited to this material.

The rotary steel rule die apparatus 14 further includes a plurality of trim cutters 30 extending from the rules 12 perpendicularly therefrom outside from the rectangle 25. As it is also believed to be well-known in the art, the trim-cutters 30 are provided to cut the trim 11 on each side of the rectangle 25 in a plurality of pieces (four (4) according to the illustrated embodiment) so as to facilitate its ejection.

Since the configuration and general operation of a rotary steel rule die apparatus 14 is believed to be well-known in the art, and for concision purposes, they will not be described furtherin.

The apparatus 14 further comprises a plurality of trim ejectors 10 for ejecting the trim 11 produced by each rule 12. As can be seen on FIG. 1, the trim ejectors 10 are mounted to the die board 18 in pair so as to provide a trim ejector 10 from each pair on a respective side of each trim-cutter 30. This arrangement has been found to increase the ejection efficiency when trim-cutters 30 are used.

The present invention is not limited to the arrangement and positioning of the trim ejectors 10 illustrated in FIG. 1. For example, trim ejectors 10 can be mounted to the board 18 on the periphery of the rectangle 25 outside thereof or of any other shape formed by the rules 12 to eject the trim produced thereby without requiring the use of trim-cutters 30.

Turning now to FIGS. 2 and 3, one of the identical trim ejectors 10 will now be described in more detail.

The trim ejector 10 comprises a leaf-like body 32 defining a trim-ejecting surface 34 extending between an ejecting edge 36 and a stem portion 38, an anchor portion 40 integrally connected to the stem portion 38 and a compressible biasing member 42 secured to the leaf-like body 32 adjacent the ejecting edge 36.

The leaf-like body 32 and the anchor portion 40 are integral and are made of UHMW plastic. Any other polymeric or resistant and flexible material can also be used. Any material which prevents sticking of the trim to the leaf-like body 32 is preferably used. According to another embodiment (not shown), the leaf-like body 32 and the anchor portion 40 are made of two individual parts which are assembled using glue or any other fastening means. They can also be configured so as to be snap-fitted for example.

The anchor portion 40 renders the installation of the trim ejectors 10 rapid and straight forward.

The leaf-like body 32 includes a U-shape portion 44 defined by a free leg 46 and an attached leg 50, mounting the U-shape portion 44 to the rest of the leaf-like body 32. The upper portion of the free leg 46 includes the afore-mentioned ejecting edge 36. The free leg 46 of the U-shape portion 44 further includes a fold-back 48 which extends in the plane defined by the trim-ejecting surface 34 towards the attached leg 50 of the U-shape portion 44 so as to partially close the gap 52 between the two legs 46 and 50.

As will be described furtherin with reference to FIGS. 4 to 7, the U-shape portion 44 of the body 32 allows the ejecting edge 36 to act as a wiper blade during operation of the trim ejector 10. The U-shape portion 44 of the body 32 allows the ejecting edge 36 to remain in contact with the steel rule 12 (see FIG. 4 for example) throughout the sequential cutting and trim ejecting operations. This contributes to minimizing the jamming of trims between the ejector 10 and the rule 12.

The leaf-like body 32 is configured so that the maximum vertical course of the edge 36 is ¼" (6.3 mm) and its maximum horizontal course is 3⁄16" (4.76 mm). The clearance angle of the edge 36, which remains substantially constant throughout the operation, is between about three (3) to twenty (20) degrees.

These operational characteristics of the leaf-like body 32 and more specifically of its edge 36 are provided only as an example. It is believed to be within the reach of a person skilled in the art to adapt the present teaching for another application or for a specific type of sheet and to modify the configuration of the U-shape portion 44 to yield other clearance and maximum courses therefore.

The anchor portion 40 is in the form of a flat base integrally connected to the leaf-like portion 32 via the stem portion 38. The stem portion 38 extends at an angle of about 20 degrees at a position corresponding of about two third from the edge of the anchor portion 40.

The trim ejector 10 is mounted to the die board 18 using an adhesive such as glue or fasteners. It is so positioned relatively to the rule 12 so that the ejecting edge 36 is parallel thereto. More specifically, the free leg 46 of the U-shape portion 44 is so positioned relatively to the rule 12 when no tension is applied to the stem portion 38 that the free leg 46 abuts the rule 12. The trim ejector is so configured and sized that, in such a neutral position, which is illustrated in FIG. 4, the ejecting edge 36 extends further the rule 12 relatively to the board 18.

The U-shape portion 44 contributes to the free legs 46 remaining in contact with the rule 12 during operation of the ejector 10 and the ejecting edge 36 acting as a scraper blade along the rule 12 as will be explained hereinbelow in more detail.

The trim ejector 10 further comprises a compressible biasing member 42 secured to the leaf-like body 32 adjacent the U-shape portion 44. The biasing member 42 is made of polyurethane foam and extends substantially throughout the width of the leaf-like body 32. Other elastomeric material can be used to make the biasing member, including without limitations neoprene foam and pure gum rubber to name a few.

As can be better seen from FIG. 3, the biasing member 42 is dimensioned so that its bottom surface 54 is leveled with the bottom surface 56 of the anchor portion 40 so that the biasing member contacts the die board 18 when the ejector 10 is secure to the board 18 via its anchor portion 40.

To simplify the mounting of the trim ejector 10 to the board 18, the biasing element 42 is not secured to the board 18. However, the biasing member 42 and leaf-like body 42 are configured so that the biasing member is complementary engaged in a recess 58 formed in the leaf-like body 32 under the trim-ejecting surface 34, adjacent the U-shape portion 44. The biasing member 42 includes a complementary portion in the form of a lip 60. The biasing member is further glued to the leaf-like body 32.

The compressible biasing member 42 is provided between the leaf-like body 32 and the die-board 18 for forcing the leaf-like body 32 to a neutral position, which corresponds to no tension being applied to the stem portion 38, when the leaf-like member 32 is moved away from the neutral position under the passage of a sheet 28 in the sheet receiving gap 22 as will be described hereinbelow in more detail.

The biasing member 42 is made of a compressible material allowing the biasing member to act as a compression spring which provides a biasing force sufficient to eject the trim 11 and greater than the friction of the free leg 46 onto the rule 12. This last force creates a scraping effect of the leg 46 onto the rule 12 and thereby helps preventing accumulation of cuttings between the rule 12 and the leg 46. To summarize, the biasing force should be sufficient to overcome the scraping force and to eject the trim.

The operation of the trim ejector 10 will now be described in more detail with reference to FIGS. 4 to 7.

As can be seen in FIG. 4, a corrugated sheet 28 or another sheet which is fed to the apparatus 14 by the two rolls 16 and 20 enters the sheet-receiving gap 22 (see arrow 62) until the gap 22. As it is well-known in the art, the feeding of the sheet 28 is synchronized with the rotation of the die cylinder 16.

During this stage, no force is applied onto the stem portion 38 of the ejector 10 which is still in a neutral position. It is also to be noted that the ejecting edge 36 extends further than the rule 12 when the ejector is in its neutral position.

Figure 5:
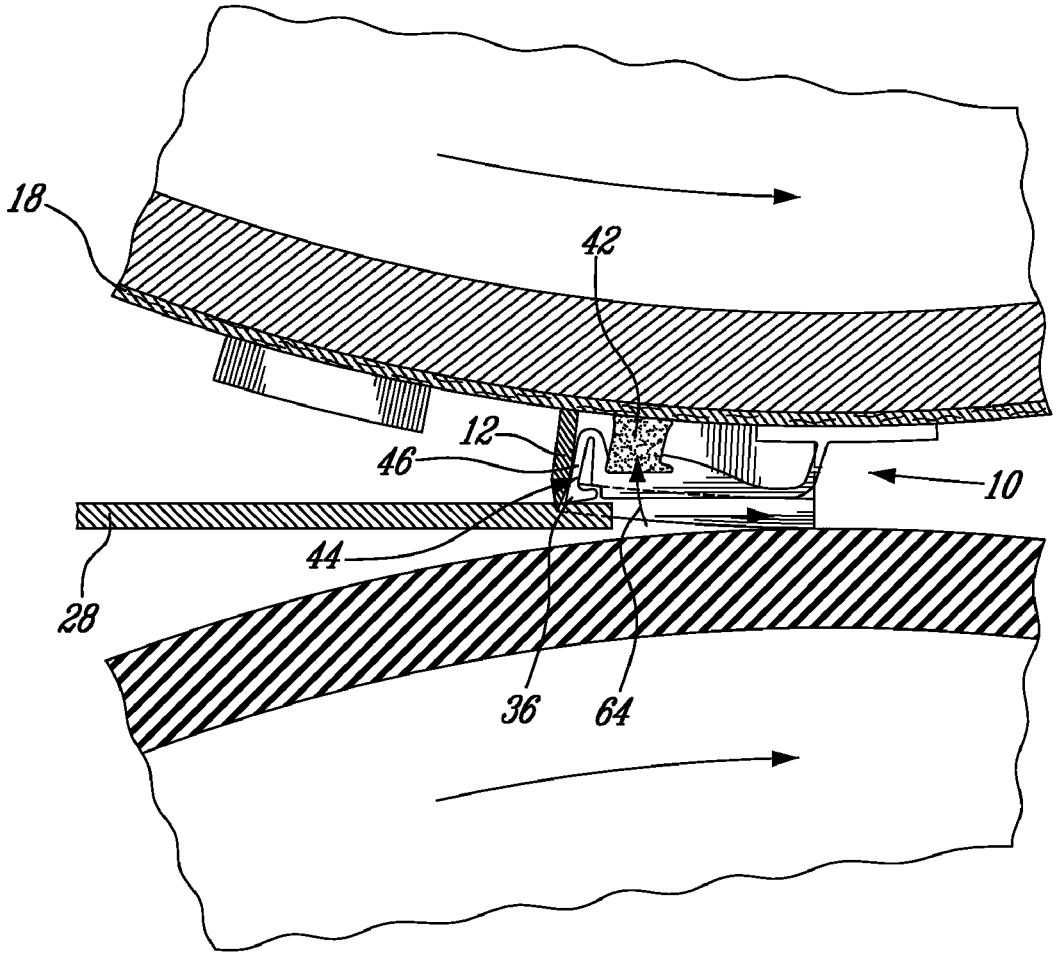

FIG. 5 illustrates the trim ejector 10 just before the beginning of the cutting of the trim by the rule 12. At this stage, the tightness of the gap 22 forces the sheet 28 to push onto the trim ejector 10 towards the die board 18 and therefore to compress the biasing member 42 (see arrow 64). The ejecting edge 36 is then pushed beyond the edge of the rule 12. The U-shape portion 44 bends and the free legs thereof 46 remains firmly applied onto the rule 12.

Figure 6:
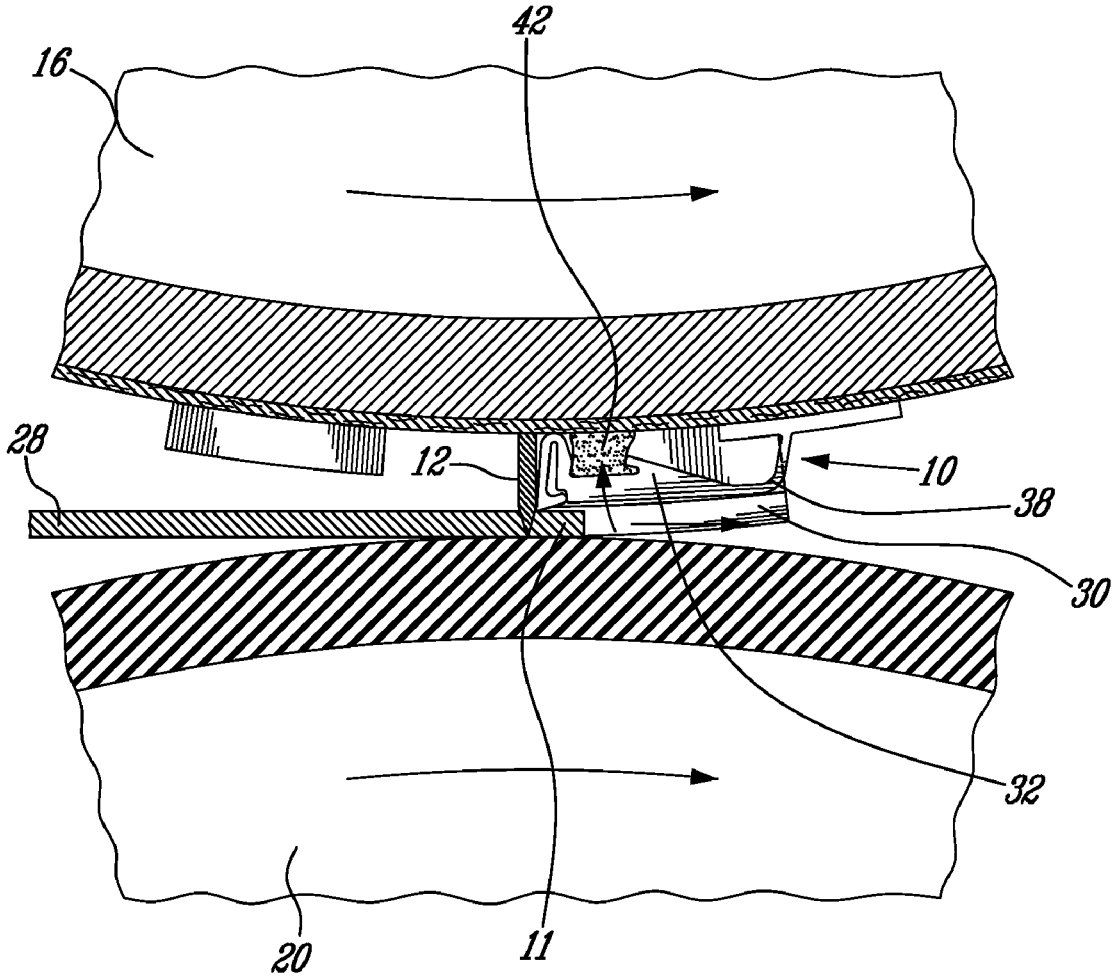

FIG. 6 illustrates the sheet 28 reaching a point between the two rolls 16 and 20 where the illustrated portion of the sheet 28 is cut by the rule 12. The resulting trim 11 is further simultaneously cut in pieces by the trim cutters 30 (only one shown in FIG. 6).

As illustrated in FIG. 6, the biasing member 42 is then fully compressed by the force applied by the sheet 28 onto the leaf-like portion 32 of the trim ejector 10. A tension is also exerted onto the stem portion 38 of the ejector 10.

Figure 7:
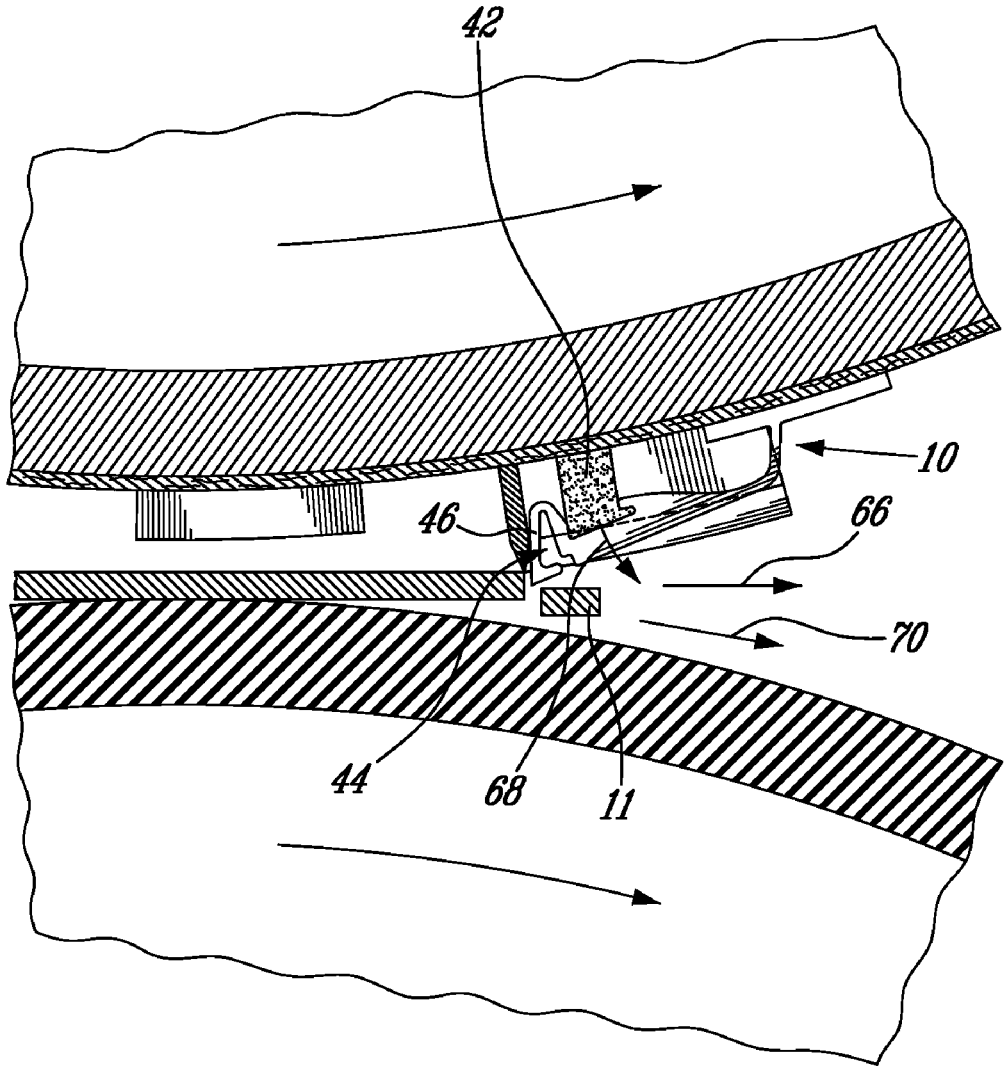

FIG. 7 shows the beginning of the exit of the sheet 28 (see arrow 66).

Since an external force is no longer applied onto the trim ejector 10, the compressed biasing member 42 pushes back the leaf-like body 32 into its neutral position (see arrow 68) which in turn ejects the trim 11 out of the gap 22 (see arrow 70).

As previously noted, the U-shape portion 44 exerts a force on its free leg 46 throughout the operation, yielding a scraping effect onto the rule 12.

The trim ejector 10 has been found to be both tear and fatigue resistant. The ejector 10 has also been found to be reliable to over 500 000 cycles.

The biasing member 42 can take other form allowing forcing the leaf-like body 32 to a neutral position, corresponding to no tension being applied to the stem portion 38, when the leaf-like member 32 is moved away from the neutral position under a passage of a sheet 28 in the sheet receiving gap. Also, the leaf-like body 32 and the biasing member 42 can be configured differently to allow attachment of the biasing member 42 to the leaf-like body 32.

Even though the trim ejector 10 has been illustrated mounted adjacent a center bevel rule, it can be used also along a side bevel rule.

Figure 8:
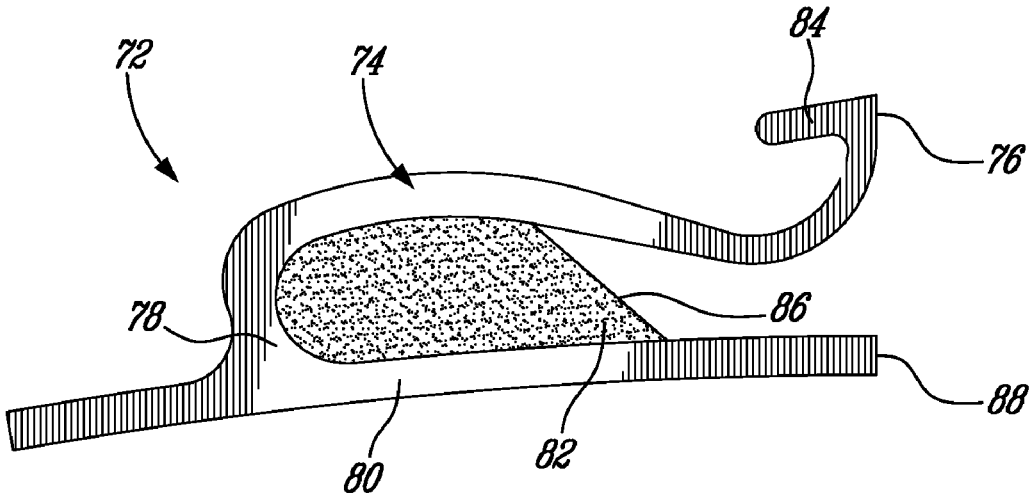
FIG. 8 is a side elevation of a trim ejector according to a second illustrative embodiment of the present invention.

Turning now to FIG. 8 of the appended drawings, a trim ejector 72 according to a second illustrated embodiment of the present invention will now be described. Since the trim ejector 72 is similar to the trim ejector 10, and for concision purposes, only the differences between these two embodiments will be described herein.

The trim ejector 72 comprises an S-shape leaf-like body 74, defining a trim-ejecting surface extending between an ejecting edge 76 and a stem portion 78, an anchor portion 80 integrally connected to the stem portion 78 and a compressible biasing member 82 secured to the leaf-like body 32 on a side thereof opposite the trim-ejecting surface adjacent the stem portion 78.

Similarly to the leaf-like body 32, the leaf-like body 74 includes a fold-back 84 extending from the ejecting edge 76 away therefrom so as to define an extension to the trim-ejecting surface. The overall shape of the leaf-like body 74 aims at increasing its flexibility to maximize the course of the ejecting edge 76 and thereby add to the trim ejecting efficiency.

The anchor portion 80 is longer than the anchor portion 40 of the trim ejector 72. The extra length of the base towards the ejecting edge 76 aims at compensating for the positioning of the biasing member 82 adjacent the stem portion 78.

The biasing member 82 is therefore secured to the leaf-like body 74 between the body 74 and the anchor portion 80. It includes a slanted side 86 opposite the stem portion 78 which provides a greater clearance for the mobile portion of the leaf-like body 74.

The trim ejector 72 is positioned relatively to the rule 12 by abutting the proximate end 88 of the anchor portion with the rule 12.

In operation, the trim ejector 72 acts similarly to the trim ejector 10 with the difference that the scraping effect provided by the U-shaped portion 44 in the case of the ejector 10 is provided by the S-shape of the leaf-like body 74 in the case of the trim ejector 72.

A trim ejector 90 according to a third illustrated embodiment of the present invention will now be described with reference to FIG. 9. Since the trim ejector 90 is similar to the trim ejector 10, and for concision purposes, only the differences between these two embodiments will be described herein.

The trim ejector 90 comprises a leaf-like body 92, defining a trim-ejecting surface 94 extending between an ejecting end portion 96 and an S-shape stem portion 98, an anchor portion 100 integrally connected to the stem portion 98 and a compressible biasing member 102 secured to the leaf-like body 92 on a side thereof opposite the trim-ejecting surface 94.

The S-shape of the stem portion 98 allows minimizing the stress of the leaf-like body 92 considering its overall shape.

Figure 9:
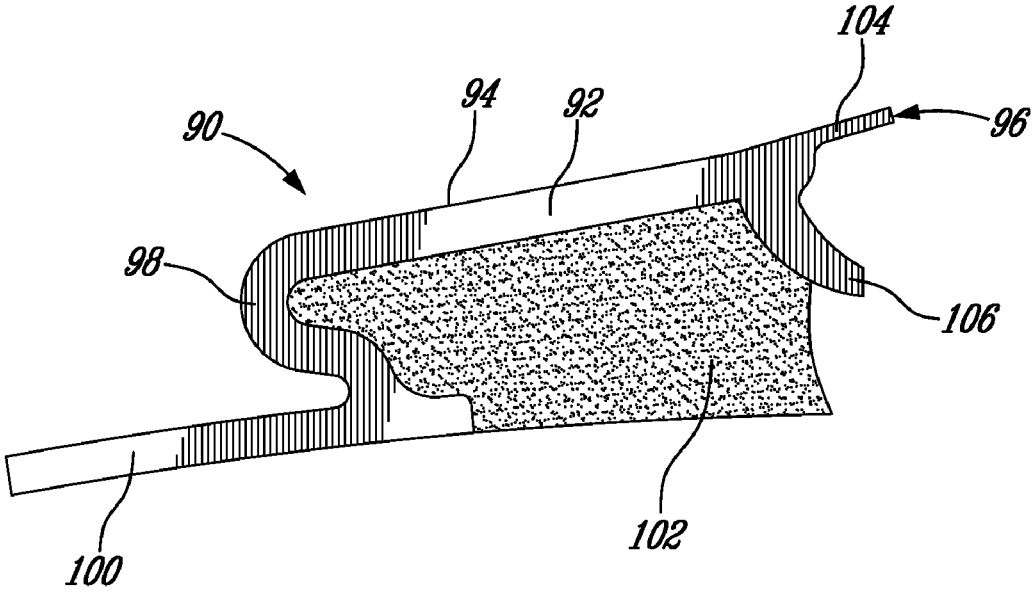
FIG. 9 is a side elevation of a trim ejector according to a third illustrative embodiment of the present invention.

The ejecting end portion 96 is in the form of a fork having a top leg 104 defining an extension of the trim-ejecting surface 94 and a bottom leg 106 biased from the top leg and defining a mechanical stop to limit the course of the of the leaf-like body 92 towards the die board 18 (not shown in FIG. 9).

The biasing member 102 is shaped to complement the contour of the inner leaf-like body 92 and is sized so as to contact the die board 18.

Figure 10:
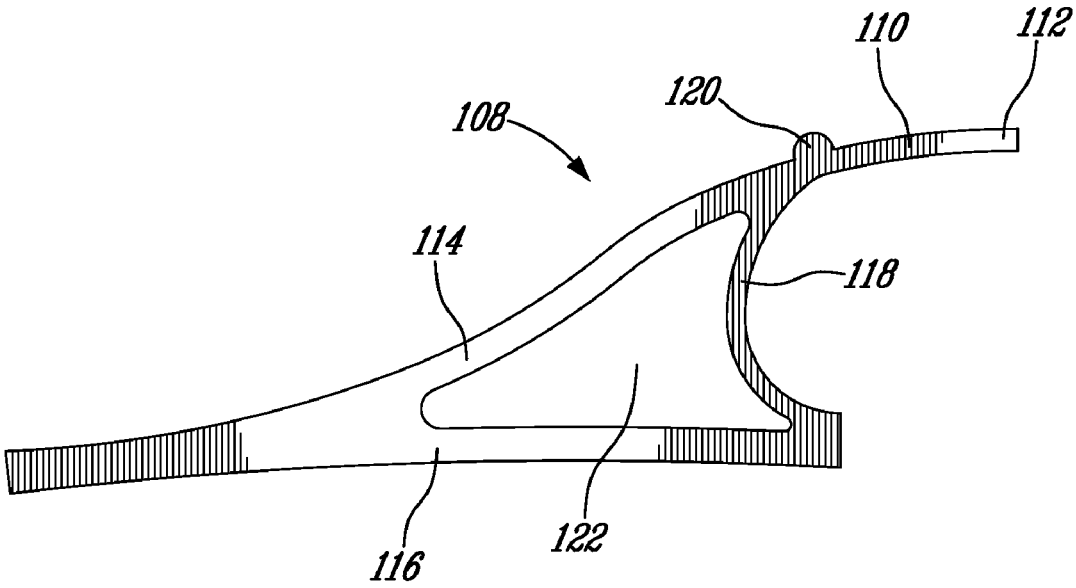
FIG. 10 is a side elevation of a trim ejector according to a fourth illustrative embodiment of the present invention.

Turning now to FIG. 10 of the appended drawings, a trim ejector 108 according to a fourth illustrated embodiment of the present invention will now be described. Since the trim ejector 108 is similar to the trim ejector 10, and for concision purposes, only the differences between these two embodiments will be described herein.

The trim ejector 108 is a one-piece ramp-shape body comprising a leaf-like portion 110, defining a trim-ejecting surface extending between an ejecting edge 112 and a stem portion 114, an anchor portion 116 integrally connected to the stem portion 116 and a compressible biasing member 118 is in the form of an arcuate segment secured to both the leaf-like portion 10 and to the anchor portion 116 therebetween.

The ejecting edge 112 is defined by a lip, which extends at the end of the leaf-like portion 110 opposite the stem portion 114 and which is intended to lie over the cutting edge of the rule 12 before the first impression. After a first pass, the excess is eliminated and the lip 112 becomes flush with the cutting bevel creating the scraping effect on the cutting rule 12.

The leaf-like portion 110 further includes a retention protrusion 120, extending along the width of the device 108 on the ramp adjacent the rule 12, to retain the material in position prior to cutting.

The leaf-like portion 110, anchor portion 116 and the biasing element 118 together define a below 122 that creates suction and air movement within the device on each cycle. This below can help eliminate dust and small particles of material that may accumulate in some applications.

Even though the ejectors 10, 72, 90 and 108 have been illustrated to eject the trim 11 resulting from the cutting of the sheet 28, their functionalities are not limited to such an application. Positioned within perimeter defined by the rectangle formed by the rules 12, the ejectors (not shown) can be used for example to replace the blocks 26 to help eject the sheet 28 after the die-cutting process. Such use of the ejectors can be in addition or alternatively to the use of further trim ejectors as described hereinabove.

Even though the trim ejectors 10, 72, 90 and 108 have all been illustrated so mounted to the die board relative to the rule that their respective ejecting edge abuts the rule while the trim ejector is in a neutral position so as to provide a scrapping effect during operation, a trim ejector according to the present invention can also be mounted to the die board so as to be positioned adjacent a rule without contacting it. Even though in such a case the above-mentioned scraping effect will be absent, the trim ejecting effect will still be present.

The width of a trim ejector according to the present invention may of course vary.

A trim ejector according to the present invention is not limited to having a compressible biasing member made of foam of an elastomeric material. It can be made for example of metal. A conventional coil spring can be sued for example.

Also, even though trim ejectors according to the present invention have been illustrated as being made partly of polymeric and/or elastomeric materials, they can also be made completely or partly of metal.

Although the present invention has been described hereinabove by way of illustrated embodiments thereof, it can be modified, without departing from the spirit and nature of the subject invention as defined in the appended claims.

What is claimed is:

1. A trim ejector for ejecting the trim produced by a rule of a rotary steel rule die apparatus, the rotary steel rule die apparatus further comprising a die cylinder including a die board provided with the rule and an anvil roll positioned parallel to the die cylinder so as to define a sheet receiving gap therebetween, the trim ejector comprising:

a flexible body defining a trim-ejecting surface extending between an ejecting edge and a stem portion;

an anchor portion connected to the stem portion of the flexible body for securing the flexible body to the die board so that the ejecting edge of the flexible body is positioned adjacent the rule generally parallel therefrom; and a compressible biasing member secured to the flexible body on a side thereof opposite the trim-ejecting surface; the compressible biasing member being for forcing the flexible body to a neutral position corresponding to no tension being applied to the stem portion, when the flexible member is moved away from the neutral position by a sheet in the sheet receiving gap;

wherein the flexible body includes a U-shape portion having a first leg attached to the trim-ejector surface and a second free leg including the ejecting edge; the anchor portion being mounted to the die board so that the second free leg abuts the rule; the U-shape portion being configured and the trim ejector being so mounted to the die board relatively to the rule so that a force is applied by the second free leg onto the rule which causes a scraping effect against the rule during operation of the trim ejector;

wherein the second free leg including a fold-back which extends towards a plane defined by the trim-ejecting surface so as to partially close an opening defined by the U-shape portion between the first and second legs thereof;

whereby, in operation, when the sheet in the sheet receiving gap causes the rule to cut a trim from the sheet, the sheet exerts the tension on the stem portion and the biasing member is compressed; when the sheet exits the sheet receiving gap, the tension on the stem portion is released and the compressible biasing member forces the flexible body to its neutral position which then pushes onto the trim and causes an ejection of the trim.

2. A trim ejector as recited in claim 1, wherein the compressible biasing member is made of an elastomeric material.

3. A trim ejector as recited in claim 1, wherein the flexible body is made of a polymeric material.

4. A trim ejector as recited in claim 1, wherein the flexible body is made of a metal.

5. A trim ejector as recited in claim 1, wherein the flexible body and the anchor portion are integral.

6. A trim ejector as recited in claim 1, wherein the compressible biasing member is mounted in a recess adjacent the U-shape portion of the flexible body; the compressible biasing member being configured and sized so as to rest on the die board when the flexible body is in the neutral position.

7. A trim ejector as recited in claim 1, wherein the anchor portion includes a flat base.

8. A trim ejector as recited in claim 1, wherein the anchor portion is secured to the die board using fasteners.

9. A trim ejector as recited in claim 1, wherein the anchor portion is secured to the die board using an adhesive.

10. A trim ejector as recited in claim 1, wherein the die board is further provided with at least one trim cutter positioned generally perpendicularly to the rule and adjacent therefrom; the trim ejector being positioned adjacent the at least one trim cutter.

11. A trim ejector as recited in claim 1 which is a one-piece body.

12. A rotary steel rule die apparatus comprising:

a die cylinder rotatably mounted to a frame including a die board provided with a plurality of steel rules mounted to the die board so as to define a die cutting tool;

an anvil roll mounted to the frame so as to be positioned parallel to the die cylinder and so as to define a sheet receiving gap therebetween; each of the plurality of steel rules producing a respective trim following a passage of a sheet in the sheet receiving gap;

the improvement wherein the apparatus further comprising:

at least one trim ejector mounted to the die board adjacent one of the plurality of steel rules for ejecting the respective trim produced by the one of the plurality of steel rules, the trim ejector comprising:

a flexible body defining a trim-ejecting surface extending between an ejecting edge and a stem portion;

an anchor portion connected to the stem portion of the flexible body secured the flexible body to the die board so that the ejecting edge of the flexible body is positioned adjacent the one of the plurality of steel rules generally parallel therefrom; and a compressible biasing member secured to the flexible body on a side thereof opposite the trim-ejecting surface; the compressible biasing member being for forcing the flexible body to a neutral position corresponding to no tension being applied to the stem portion, when the flexible member is moved away from the neutral position by a sheet in the sheet receiving gap; wherein the flexible body includes a U-shape portion having a first leg attached to the trim-ejector surface and a second free leg including the ejecting edge; the anchor portion being mounted to the die board so that the second free leg abuts the rule; the U-shape portion being configured and the trim ejector being so mounted to the die board relatively to the rule so that a force is applied by the second free leg onto the rule which causes a scraping effect against the rule during operation of the trim ejector;

wherein the second free leg including a fold-back which extends towards a plane defined by the trim-ejecting surface so as to partially close an opening defined by the U-shape portion between the first and second legs thereof;

whereby, in operation, when the sheet in the sheet receiving gap causes the rule to cut a trim from the sheet, the sheet exerts the tension on the stem portion and the biasing member is compressed; when the sheet exits the sheet receiving gap, the tension on the stem portion is released and the compressible biasing member forces the flexible body to its neutral position which then pushes onto the trim and causes an ejection of the trim.

13. An ejector for ejecting a sheet in a rotary steel rule die apparatus, the rotary steel rule die apparatus further comprising a die cylinder including a die board provided with a matrix of steel rules and an anvil roll positioned parallel to the die cylinder so as to define a sheet receiving gap therebetween, the ejector comprising:

a flexible body defining a sheet-ejecting surface extending between an ejecting edge and a stem portion;

an anchor portion connected to the stem portion of the flexible body for securing the flexible body to the die board so that the ejecting edge of the flexible body is positioned adjacent the rule generally parallel therefrom; and a compressible biasing member secured to the flexible body on a side thereof opposite the sheet-ejecting surface; the compressible biasing member being for forcing the flexible body to a neutral position corresponding to no tension being applied to the stem portion, when the flexible member is moved away from the neutral position by a sheet in the sheet receiving gap;

wherein the flexible body includes a U-shape portion having a first leg attached to the trim-ejector surface and a second free leg including the ejecting edge; the anchor portion being mounted to the die board so that the second free leg abuts the rule; the U-shape portion being configured and the trim ejector being so mounted to the die board relatively to the rule so that a force is applied by the second free leg onto the rule which causes a scraping effect against the rule during operation of the trim ejector;

wherein the second free leg including a fold-back which extends towards a plane defined by the trim-ejecting surface so as to partially close an opening defined by the U-shape portion between the first and second legs thereof;

whereby, in operation, when the sheet is in the sheet receiving gap, the sheet exerts the tension on the stem portion and the biasing member is compressed; when the sheet exits the sheet receiving gap, the tension on the stem portion is released and the compressible biasing member forces the flexible body to its neutral position which then pushes onto the sheet and causes an ejection of the sheet.

* * * * *